United States Patent [19]

Sautereau

[11] 3,930,313

[45] Jan. 6, 1976

[54] DRAWING APPARATUS

[76] Inventor: Lucien Emile Sautereau, 16, Avenue Montaigne, 75008 Paris, France

[22] Filed: Aug. 19, 1974

[21] Appl. No.: 498,870

[30] Foreign Application Priority Data

Sept. 14, 1973 France ..... 73.33174
July 3, 1974 France ..... 74.23188

[52] U.S. Cl. ..... 33/79 R; 33/79 A
[51] Int. Cl.[2] ..... B43L 13/02
[58] Field of Search ..... 33/76 R, 79 R, 79 A, 79 B, 33/79 C, 79 D, 25 R, 80

[56] References Cited

UNITED STATES PATENTS

| | | | |
|---|---|---|---|
| 747,522 | 12/1903 | Wilkes | 33/79 A |
| 1,441,939 | 1/1923 | Muller | 33/79 R |
| 1,482,606 | 2/1924 | Goldrick | 33/80 |
| 3,074,173 | 1/1963 | Little | 33/76 |
| 3,120,060 | 2/1964 | Graham | 33/76 |
| 3,343,267 | 9/1967 | Wolf | 33/76 |

FOREIGN PATENTS OR APPLICATIONS

| | | | |
|---|---|---|---|
| 440,653 | 10/1948 | Italy | 33/80 |
| 443,507 | 12/1948 | Italy | 33/79 R |

*Primary Examiner*—Richard E. Aegerter
*Assistant Examiner*—John W. Shepperd
*Attorney, Agent, or Firm*—Haseltine, Lake & Waters

[57] ABSTRACT

Drawing apparatus adapted for attachment to a drawing board and comprising a carriage supported for travel on the upper edge of the drawing board and carrying a depending rail which extends parallel to the lateral edges of the drawing board. A ruler-carrier head is slidably mounted on the rail. A linkage assembly constituted by two interconnected articulated parallel parallelogram linkages is connected by means of the short arm of one of the linkages to the carriage and by means of the short arm of the other of the linkages to the rear surface of the drawing board.

8 Claims, 14 Drawing Figures

DRAWING APPARATUS

The invention relates to drawing apparatus and more precisely to apparatus for moving the rule-carrying head, exactly parallel to itself, over the drawing board, as is essential in the work of a draftsman.

Known in the prior art are two types of drawing apparatus of this kind, namely : double parallelogram apparatus, usually balanced by means of counterweights, in accordance with French Pat. No. 588 203, and carriage-type apparatus. Apparatus of the double parallelogram type, the principle of which is shown diagrammatically in FIG. 1, occupies an excessive amount of space, and movements of its counterweight also cause trouble. The carriage-type apparatus, the principle of which is shown diagrammatically in FIG. 2, is lacking in precision; the upper horizontal rail, along which the carriage moves, is either integral with the drawing board over its entire length and is deformed if the drawing board becomes warped, or is secured only at its two ends (FIG. 3), and when deflected under the weight of the carriage and the head, renders parallel movement of the head no longer possible (this being shown in an exaggerated manner by the broken lines in FIG. 3 so as to illustrate the defect more clearly); furthermore the condition of the rail and the runners of the carriage (flattening or contamination by dust) has an adverse effect upon precision.

An object of the present invention is to provide drawing apparatus which eliminates these disadvantages.

Briefly, in accordance with the invention, the drawing apparatus which, in the customary manner includes a carriage which holds a rail parallel to the lateral edges of the drawing board, on which rail the ruler-carrying head slides, comprises a runner, on the carriage and adapted to move along the upper edge of the drawing board, and a double articulated parallelogram, which is mounted flat against the rear of the drawing board, one of the two short sides that are not common to the two parallelograms being secured to the carriage, and the other being secured to the drawing board.

Thus the drawing apparatus of the invention occupies very little space, and ensures that the rule-carrying head executes precise and true parallel movements.

Preferably, but not necessarily, the two short sides of the articulated double parallelograms are parallel to the upper edge of the drawing board; the short side secured to the drawing board may be disposed close to a corner of the drawing board, but it is preferably located near the median zone of the upper edge of the drawing board.

If required, the weight of the articulated double parallelogram which, although small, tends to draw the apparatus into a position opposite the short side secured to the drawing board, may be counter-balanced by shaping the track along which the runner of the carriages moves with an outwardly curved form which counteracts said weight in all positions.

It has also been found when using the apparatus, that the right to left or reverse movement of one of the two parallelograms in relation to each other cannot be conveniently achieved at the precise moment at which the two parallelograms reach the vertical position.

Consequently, to eliminate this drawback, the invention provides means for rendering the rotary movement of each one of the two parallelogarms about their two common articulation points interdependent on one another.

In accordance with a further feature of the invention, said means comprises a first pulley, which pivots about the axis of the first common articulation and is solidly connected to one arm of one of the parallelograms, and a second pulley, which pivots about the axis of the second common articulation and is solidly connected to an arm of the other parallelogram, these two pulleys being interconnected by a transmission means, for example a crossed cord, which enables one of the pulleys to be rotated in the opposite direction to that of the other.

Non-limiting examples of embodiments of the invention will now be described with reference to the annexed drawings, in which.

Figure 1:
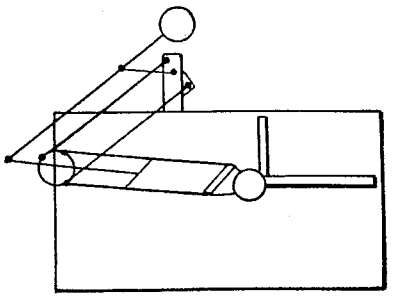
FIG.1 PRIOR ART
FIGS. 1 to 3 illustrate prior art forms of drawing apparatus.
Figure 2:
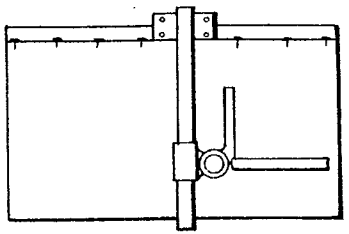
FIG.2 PRIOR ART
Figure 3:
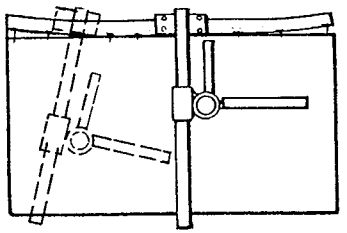
FIG.3 PRIOR ART
Figure 4:
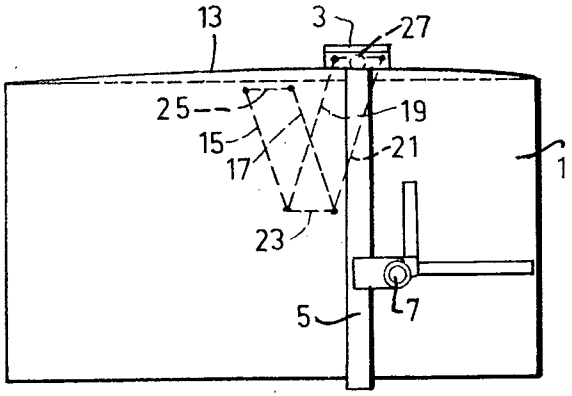
FIG. 4 shows one embodiment of drawing apparatus according to the invention.
Figure 7:
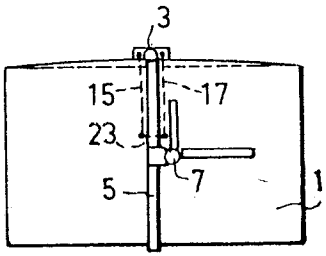
Figure 8:
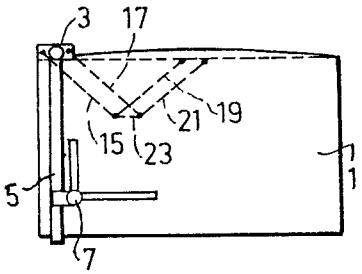
Figure 9:
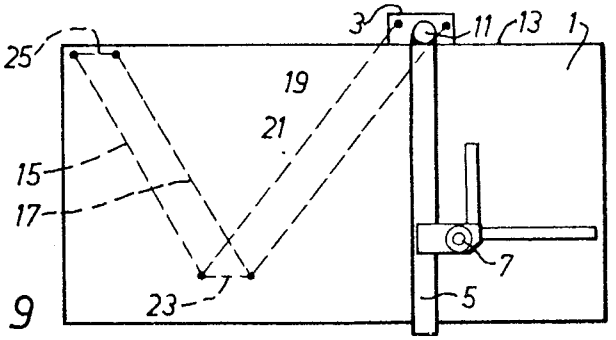
Figure 10:
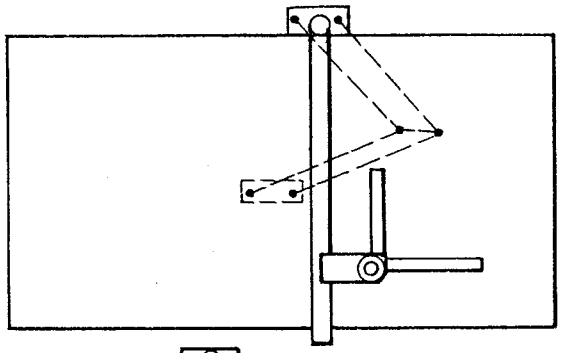
Figure 11:
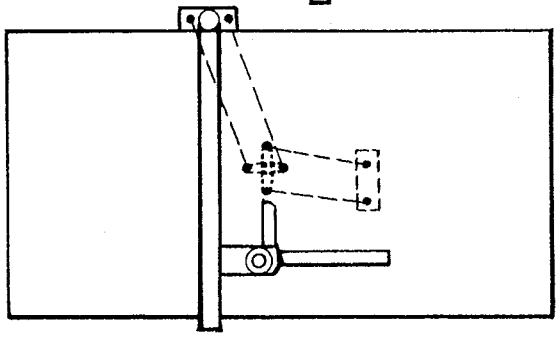
Figure 12:
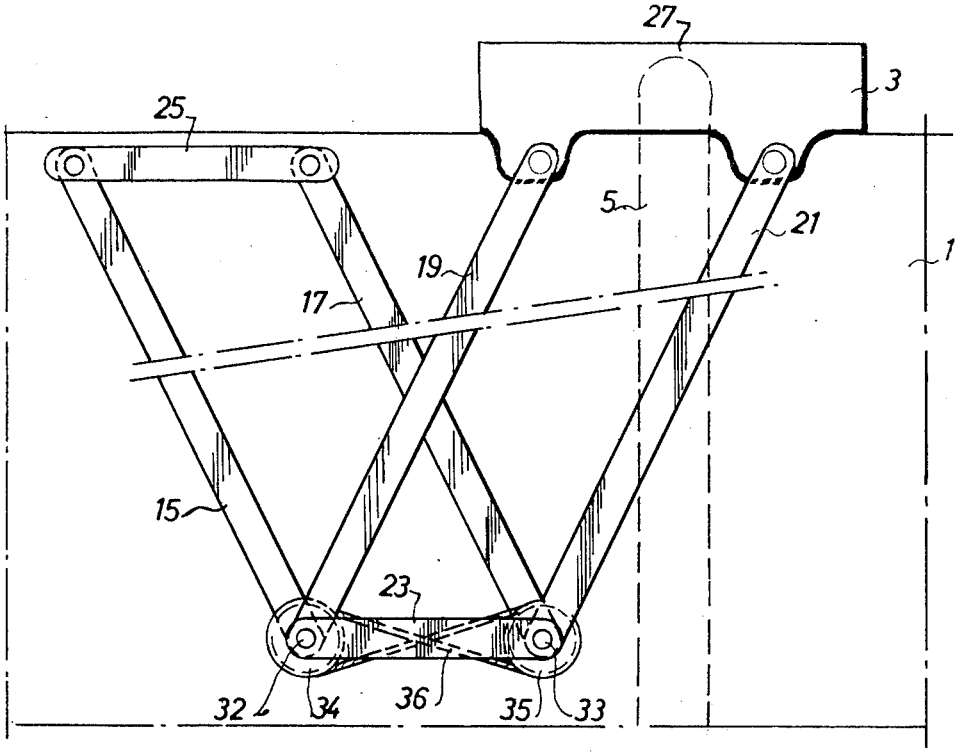
Figure 13:
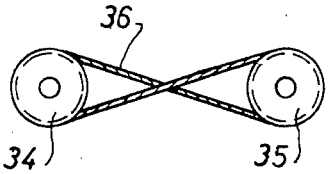
Figure 14:
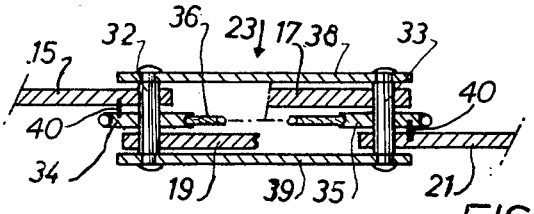

FIGS. 7 and 8, similar to FIG. 4, shows two other positions of the apparatus seen in FIG. 4;

FIGS. 9, 10 and 11, similar to FIG. 4, show three other embodiments of the invention;

FIG. 12 is a diagrammatic illustration of a preferred embodiment of the invention;

FIG. 13 illustrates the system of pulleys and cords used in the drawing apparatus illustrated in FIG. 12; and FIG. 14 is a section through part of the drawing apparatus illustrated in FIG. 12.

Figure 6:
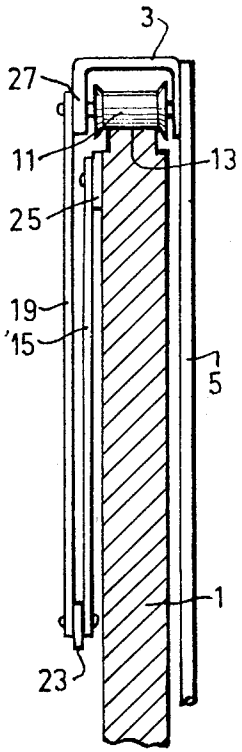
FIG. 6 shows a detail of the apparatus of FIG. 5.
Figure 5:
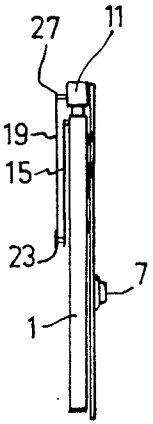
FIG. 5 is a side view of the apparatus in FIG. 4.

Referring to FIGS. 4, 5 and 6, a drawing board 1 is equipped in the customary matter with a carriage 3 supporting a rail 5, parallel to the lateral edges of the drawing board 1 and on which slides a ruler-carrying head 7. According to the invention, the carriage 3 is provided with a single runner 11 which moves along the upper edge 13 of the drawing board 1, and exact parallel movement of the rail 5 is ensured by a double articulated parallelogram having four long arms 15, 17, 19 and 21, a common short arm 23, a short side 25 secured to the drawing board 1, and a short side 27 secured to, or constituted by, the carriage 3. FIGS. 7 and 8 show the shapes of the articulated double parallelogram in two positions of the rail 5 that are different from those shown in FIG. 4. Referring again to FIG. 4, it will be seen that the short sides 23, 25 and 27 of the parallelograms are parallel to the upper edge 13 of the drawing board 1, but this preferred arrangement is not essential; these sides could be inclined, or even parallel to the lateral edges of the drawing board 1. Referring to the details seen in FIG. 6, the runner 11 has two cheeks or flanges whereby it is guided on the upper edge 13, but guiding could also be effected by the cheeks of the carriage 3. Again referring to FIG. 4, the upper edge 13 of the drawing board 1 is outwardly curved, with the top of the curve at the center, for the purpose of counteracting pull towards the center due to the weight of the five arms 15, 17, 19, 21 and 23; as already stated, this arrangement is optional. In FIG. 4, the short side 25 is secured at the median zone of the edge of the drawing board 1, but it could also be secured elsewhere as shown for example in FIGS. 9, 10 and 11.

Referring to FIG. 12, the drawing board 1 is equipped with a carriage 3 holding the rail 5 on which the rulercarrying head, not illustrated, is adapted to slide. Exact parallelism between the rail 5 and the lateral edges of the drawing board 1 is ensured by said articulated double parallelogram comprising the four arms 15, 17, 19 and 21, the short common arm 23, the short side 25 secured to the drawing board 1, and the short side 25 secured to, or constituted by, the carriage 3. The arm 15 of one of the parallelograms and arm 19 of the other parallelogram pivot about a common spindle 32 mounted at one of the ends of the short common arm 23, whereas the arms 17 and 21 are articulated in a similar manner about a spindle 33 mounted on the other end of the short common arm 23. In accordance with one feature of the invention, the arms 15 and 21 are each solidly connected to a pulley 34 and 35 respectively, the pulley 34 being pivotable about a spindle 32, and the pulley 35 being pivotable about a spindle 33. These two pulleys 34 and 35 are interconnected by a crossed cord 36, this connection being illustrated in detail in FIG. 13. It will be appreciated that the cord 36 or even the system consisting of the cord 36 and the pulleys 34 and 35 could be replaced by any other means that causes the arm 15 to rotate about the spindle 32 in one direction, and the arm 21 to rotate about the spindle 33 in the opposite direction.

Referring to FIG. 14, the short common arm 23 is constituted by two parallel flat elements 38 and 39 interconnected at their ends by the two spindles 32 and 33. The arm 15 and the pulley 34 solidly connected thereto, and the arm 19 pivot successively about the spindle 32. In a similar manner, the spindle 33 supports the arm 21, the pulley 35 solidly connected thereto, and finally the arm 17. As previously indicated, the pulleys 34 and 35 are interconnected by crossed cord 36.

I claim:

1. Drawing apparatus in combination with a drawing board having upper and lower longitudinal edges, left and right lateral edges, and front and rear surfaces, said drawing apparatus comprising a carriage including runner means for traveling on the upper edge of the drawing board, a rail secured to said carriage and extending over said front face of the drawing board parallel to the lateral edges of the drawing board with the runner means on said upper edge, a drafting head with means movably mounting the same on said rail, and a linkage assembly constituted by two interconnected articulated parallelogram linkages, one of said parallelogram linkages having a short arm with means attaching the short arm to the rear surface of the drawing board, the other of the parallelogram linkages having a short arm with means attaching the same to said carriage, each said parallelogram linkage having a second short arm, the second arms of the two linkages being constituted by a common member.

2. Drawing apparatus as claimed in claim 1, in which said short arms of the linkages are arranged with respect to said carriage so as to be parallel to the upper edge of the drawing board when the carriage is mounted thereon.

3. Apparatus as claimed in claim 2, in which said short arm of said one parallelogram linkage is secured to the rear surface of the drawing board in the median zone of the upper edge of the drawing board.

4. Apparatus as claimed in claim 3, in which the upper edge of the drawing board is outwardly curved.

5. Apparatus as claimed in claim 1, wherein said linkage assembly further comprises two common spindles connecting said common arm to two parallelogram linkages and means rotationally interconnecting said two parallelogram linkages about said spindles for rendering the rotary movement thereof interdependent on one another.

6. Apparatus as claimed in claim 5, in which said means interconnecting said parallelogram linkages comprises a first pulley rotatable about one spindle and solidly connected to one of the parallelogram linkages and a second pulley rotatable about the second spindle and solidly connected to the other parallelogram linkage, and a transmission means interconnecting said pulleys so that they are rotated in opposite directions.

7. Apparatus according to claim 6, in which said transmission means comprises a crossed cord.

8. Apparatus as claimed in claim 7, in which said short arm common to the two parallelograms is constituted by two parallel flat elements said two spindles interconnecting said elements at each of the ends thereof, said parallelogram linkages each having long arms pivotably mounted on respective spindles, said pulleys being mounted on respective spindles and fixedly secured with the long arms of respective parallelogram linkages.

* * * * *